US005975359A

United States Patent [19]

Van Marcke

[11] Patent Number: 5,975,359

[45] **Date of Patent: *Nov. 2, 1999**

[54] NEEDLE ENGAGING SOAP BAG

[75] Inventor: Karel Carl Van Marcke, Kruishoutem, Belgium

[73] Assignee: International Sanitary Ware Manufacturing CY, S.A., Belgium

[ * ] Notice: This patent is subject to a terminal disclaimer.

[21] Appl. No.: 08/883,721

[22] Filed: Jun. 27, 1997

Related U.S. Application Data

[63] Continuation-in-part of application No. 08/580,425, Dec. 27, 1995, Pat. No. 5,791,519.

[30] Foreign Application Priority Data

Dec. 27, 1996 [EP] European Pat. Off. ..... 96203618

[51] Int. Cl.[6] ..... B67D 5/00

[52] U.S. Cl. ..... 222/82; 222/83; 222/107

[58] Field of Search ..... 222/82, 83, 88, 222/95, 105, 107, 382

[56] References Cited

U.S. PATENT DOCUMENTS

| | | | |
|---|---|---|---|
| 2,986,142 | 5/1961 | Bieberdorf et al. | 128/272 |
| 3,035,737 | 5/1962 | Speas | 222/82 |
| 3,455,487 | 7/1969 | Crippen et al. | 222/76 |
| 3,974,942 | 8/1976 | Gray et al. | 222/83.5 |
| 3,991,912 | 11/1976 | Soto | 222/89 |
| 4,008,830 | 2/1977 | Meshberg | 222/95 |
| 4,008,831 | 2/1977 | Vidilles | 222/95 |
| 4,261,356 | 4/1981 | Turner et al. | 128/214 R |
| 4,265,372 | 5/1981 | Wainberg | 222/82 |
| 4,316,555 | 2/1982 | Smith | 222/83.5 |
| 4,335,833 | 6/1982 | Arabian | 222/23 |
| 4,484,697 | 11/1984 | Fry, Jr. | 222/95 |
| 4,527,716 | 7/1985 | Haas et al. | 222/83.5 |
| 4,863,066 | 9/1989 | Uffenheimer et al. | 222/1 |
| 4,938,421 | 7/1990 | Berfield et al. | 239/309 |
| 4,946,072 | 8/1990 | Albert et al. | 222/105 |
| 4,956,883 | 9/1990 | Lane | 4/605 |
| 4,998,850 | 3/1991 | Crowell | 406/48 |
| 5,004,158 | 4/1991 | Halem et al. | 239/310 |
| 5,046,648 | 9/1991 | Herbstzuber | 222/638 |
| 5,178,300 | 1/1993 | Haviv et al. | 222/95 |
| 5,188,261 | 2/1993 | Butters | 222/107 |
| 5,195,655 | 3/1993 | Bukhman | 222/1 |
| 5,215,216 | 6/1993 | Van Marcke | 222/1 |
| 5,251,787 | 10/1993 | Simson | 222/95 |
| 5,497,909 | 3/1996 | Wirsig et al. | 222/82 |
| 5,791,519 | 8/1998 | Van Marcke | 222/82 |

FOREIGN PATENT DOCUMENTS

| | | | |
|---|---|---|---|
| 921819 | 2/1973 | Canada | 154/140 |
| 3529659 | 2/1987 | Germany | 222/82 |
| 1224592 | 4/1984 | Russian Federation . | |
| 623087 | 5/1949 | United Kingdom . | |

*Primary Examiner*—Philippe Dergkshani
*Attorney, Agent, or Firm*—Cahill, Sutton & Thomas P.L.C.

[57] ABSTRACT

A source of liquid soap for washbasins and the like is provided by a flexible, collapsible bag filled with liquid soap. A hollow open tipped needle is penetrably inserted through the material of the bag, which penetration develops a seal about the needle. The needle is connected through a conduit to a dispenser for the soap. A source of vacuum in communication with the conduit, the force of gravity or a force externally imposed upon the bag to compress it, actuates a flow of soap from the bag through the needle for discharge from the dispenser. As liquid soap is evacuated from the bag, the bag collapses. Upon depletion of the soap, the needle is withdrawn and inserted into a replacement bag of soap.

55 Claims, 6 Drawing Sheets

NEEDLE ENGAGING SOAP BAG

CROSS-REFERENCE TO RELATED APPLICATIONS

The present application is a continuation-in-part application of an application entitled "SOAP BAG", filed on Dec. 27, 1995 and assigned Ser. No. 08/580,425 now U.S. Pat. No. 5,791,519, describing an invention by the present inventor.

BACKGROUND OF THE INVENTION

1. Field of the Invention

The present invention relates to soap dispensers and, more particularly, to collapsible containers for dispensing liquid soap.

2. Description of Related Art

Dispensation of soap at a washbasin is quite common. Usually, such dispensers include a fixed container of liquid soap into which is inserted a plunger having an outlet tube. When a user depresses a knob at the end of a stem associated with the plunger, soap is hydraulically forced from the soap container and through the outlet tube. Periodically, the liquid soap in the container is replenished. The requisite touching of the structure attendant the soap dispenser tends to have the effect of spreading disease as a result of bacteria, viruses and other micro-organisms being transferred to the structure and from the structure to the hands of a subsequent user. For the handicapped or infirm, the required manipulation may be very difficult or impossible and result in a failure to use the soap available and is a potential unnecessary spread of disease.

Various soap dispensers have been used that dispense soap from a flexible bag by squeezing or compacting the soap bag directly or through a lever. Such mechanisms require a certain amount of forceful manipulation that may be beyond the capability of a handicapped or infirm person. Furthermore, the resulting pressurization of the soap bag may cause it to burst, particularly if the mechanism is manipulated with excessive force.

Gravity feed soap dispensers, whether dispensing soap from a rigid or flexible container, have been used. Such devices dispense soap in response to manipulation of a valve mechanism for opening a discharge outlet/tube. The flow rate of such devices is primarily a function of the head pressure and congestion at and about the outlet. As liquid soap has a tendency to form a crust due to evaporation, the size of the outlet may become compromised to prevent any or only an insignificant amount of soap dispensation.

SUMMARY OF THE INVENTION

A bag for dispensing a personal hygiene liquid, such as liquid soap, is constructed from laminated sheets of plastic material forming a sealed container. An open tipped hollow needle is penetrably inserted through one of the walls of the container formed by the sheets of material to provide a discharge conduit. A seal about the circumference of the needle is formed during penetration by the gripping action of the sheet material due to stretching and curling of the sheet material adjacent the circumferential surface of the needle. A conduit extending from the needle conveys soap to a discharge outlet in response to an applied source of vacuum. The ambient atmospheric pressure will cause the soap bag to collapse as a function of the source of vacuum and a quantity of liquid soap will be discharged. Discharge may also be effected by using the force of gravity or by an externally applied force to compress the soap bag. When depleted, the soap bag is replaced by simply withdrawing the needle from the soap bag, discarding the soap bag and penetrably inserting the needle into a replacement soap bag.

It is therefore a primary object of the present invention to provide a collapsible liquid soap bag for dispensing soap through a bag penetrating open tipped hollow needle and a conduit extending from the needle.

Another object of the present invention is to provide a collapsible bag for liquid soap that automatically forms a seal about a bag penetrating soap discharge hollow needle upon penetration of the needle.

Still another object of the present invention is to provide a liquid soap bag formed from multi-layered sheet material to prevent leakage and chemical reaction with the liquid soap and to form a seal upon penetrable insertion of a hollow needle.

Yet another object of the present invention is to provide a liquid soap bag of multi-layered sheet material having a non-tearing layer to form a seal about a penetrating hollow needle.

A further object of the present invention is to provide a liquid soap bag for sealed penetrable engagement by an open tipped hollow needle to dispense soap in response to the force of gravity.

A yet further object of the present invention is to provide a soap dispensing system selectively responsive to a vacuum source for dispensing soap from a closed liquid soap bag through a hollow needle and attached conduit.

A still further object of the present invention is to provide a method for dispensing soap from a liquid soap bag through a hollow needle in penetrable sealed engagement with the bag.

These and other objects of the present invention will become apparent to those skilled in the art as the description thereof proceeds.

BRIEF DESCRIPTION OF THE DRAWINGS

The present invention will be described with greater specificity and clarity with reference to the following drawings, in which.

DETAILED DESCRIPTION OF THE PREFERRED EMBODIMENT

Figure 1:
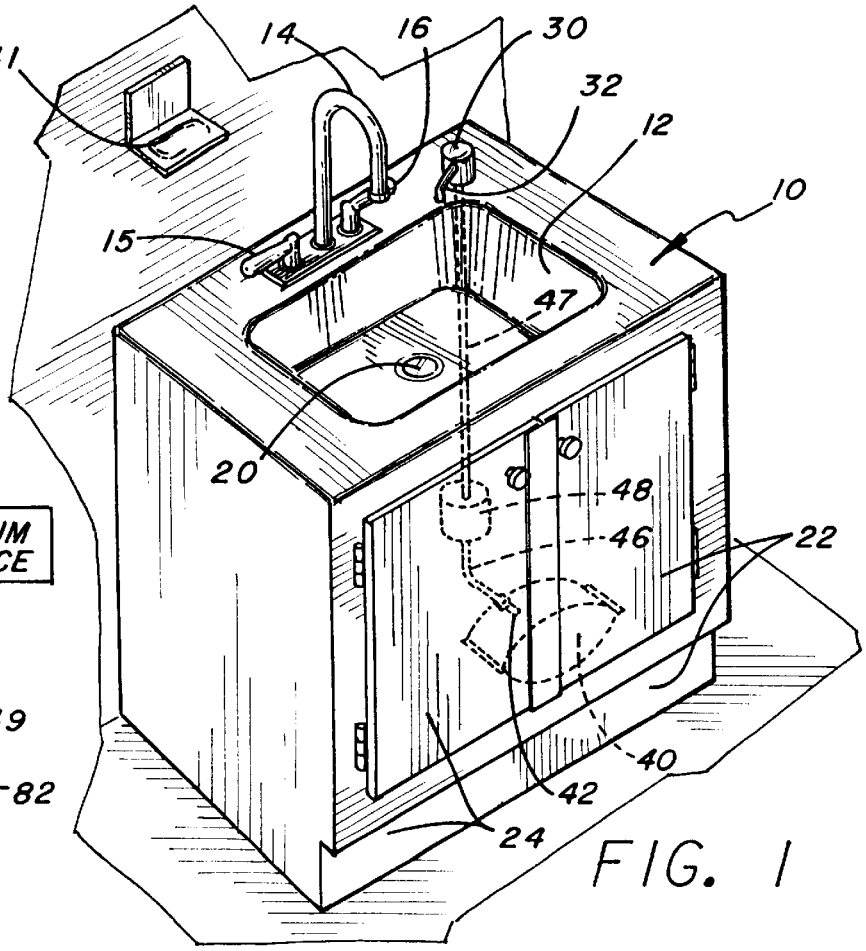
FIG. 1 illustrates a representative wash basin incorporating the present invention.

Referring to FIG. 1, there is shown a representative cabinet 10 supporting a wash basin 12. A spigot 14 in combination with handles 16,18 associated with hot and cold water valves are mounted upon cabinet 10 to provide hot and cold water, selectively, through the spigot. The wash basin includes a conventional drain 20. Cabinet doors 22,24 provide access to the interior of cabinet 10 for installation and repair of the plumbing fixtures as well as for storage purposes. A soap dispenser 30 is mounted on cabinet 10 adjacent wash basin 12 to permit a user to receive liquid soap discharged through outlet 32.

Figure 2:
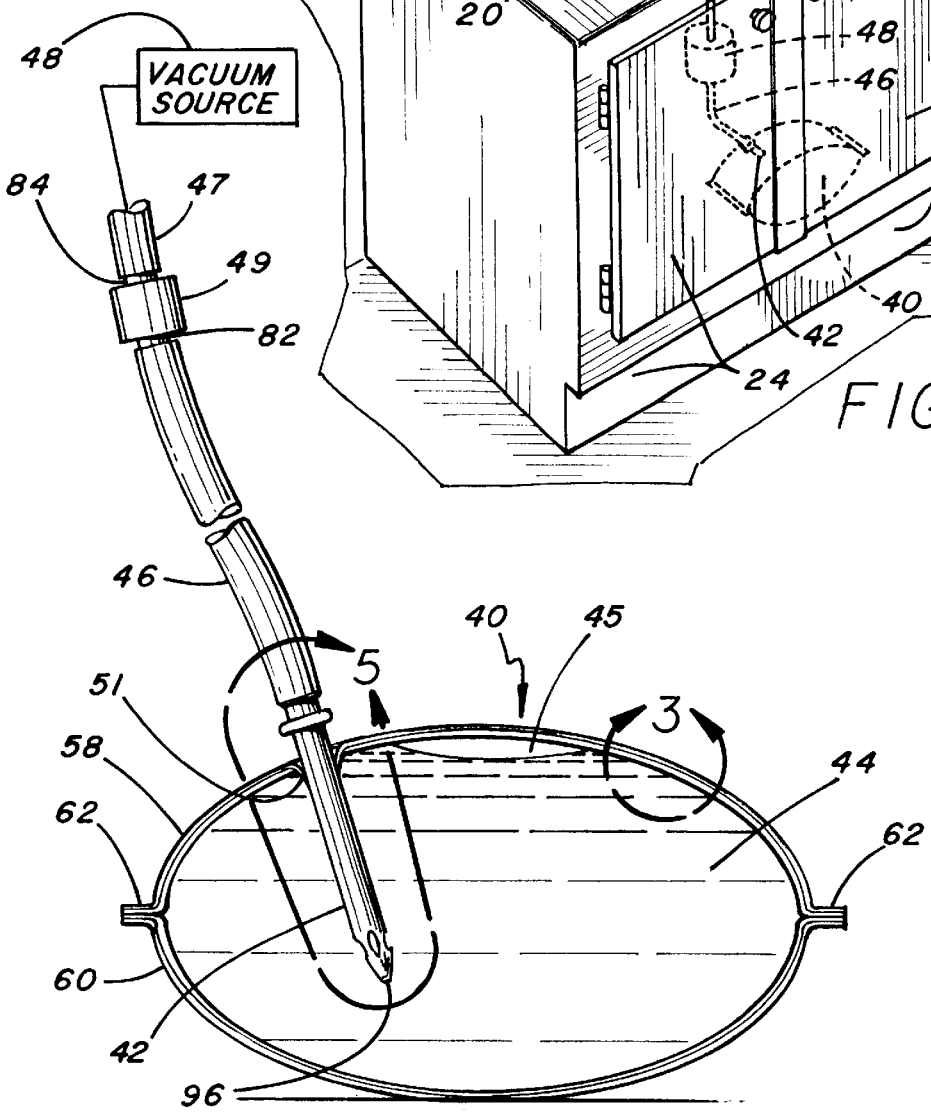
FIG. 2 is a partial cross-sectional view of the present invention.

Referring jointly to FIGS. 1 and 2, further details attendant the apparatus for dispensing soap will be described. A collapsible container or bag 40 for dispensing liquid soap may be mounted at any convenient location within cabinet 10 or at another location of convenience. For instance, it could be mounted upon shelf 41 above outlet 32 to permit flow of liquid soap to the outlet in response to the force of gravity. A hollow needle 42 is inserted into penetrable engagement with bag 40 to permit egress of liquid soap 44 from within the bag. The bag may include a small air pocket 45 formed during manufacture of the filled bag. A conduit 46 conveys liquid soap from needle 42 to soap dispenser 30 in response to a source of vacuum 48.

Alternatively, the bag may be placed at a location permitting flow into and through conduits 46,47 in response to the force of gravity. Alternatively, a compressive force applied to bag 40 may be employed to urge flow into and through conduits 46,47. A check valve 49 precludes flow of liquid soap back into bag 40. The source of vacuum may be an apparatus of any of various configurations and modes of operation. A source of vacuum operable in response to a flow of water discharged through spigot 14 is disclosed in U.S. Pat. No. 5,215,216, incorporated herein by reference. Herein, a flexible membrane divides a cavity into first and second chambers. A flow of water adjacent or proximate a side of the membrane through the first chamber increases the pressure within the first chamber to increase its volume and reduce the volume in the second chamber. The second chamber is disposed intermediate a source of liquid soap and an outlet. Upon cessation of water flow, the volume of the first chamber will decrease and the volume of the second chamber will increase. The resulting periodic changes in volume in the second chamber alternatively reduces the pressure within the second chamber to draw liquid soap thereinto and a subsequent increase in pressure, causes a discharge of the liquid soap from the second chamber through the outlet. Reverse flow of the liquid soap is prevented by use of one or more check valves. Such apparatus has particular utility in combination with the present invention as it requires no source of electrical power and is operated whenever a user performs a washing function at wash basin 12.

A primary commercial benefit through deployment of liquid soap filled bag 40 is that of permitting periodic replacement without incurring spillage of the liquid soap. Furthermore, the liquid soap filled bags can be stored indefinitely in preparation for use at any convenient location. Finally, spillage usually resulting from the filling of prior art soap containers is avoided and spillage of replacement fixed or collapsible prior art liquid soap containers during mechanical attachment to conduits is eliminated.

Figure 3:
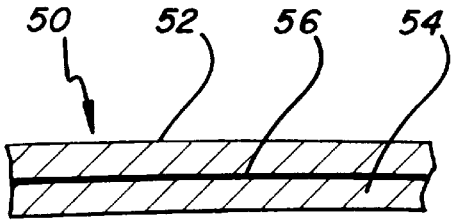
FIG. 3 is a detail view taken within dashed circle 3 illustrated in FIG. 2.
Figure 4:
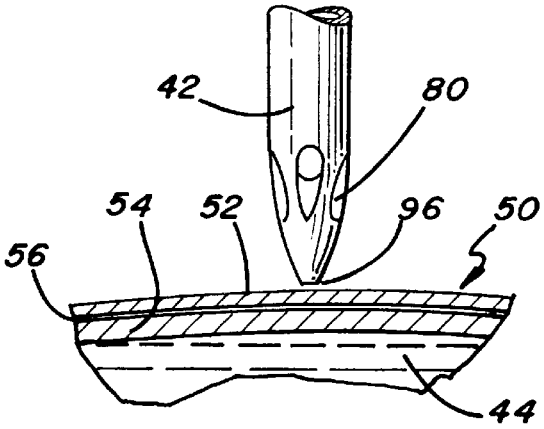
FIG. 4 is a partial detail view illustrating initial penetration by a needle of a liquid soap bag.
Figure 5:
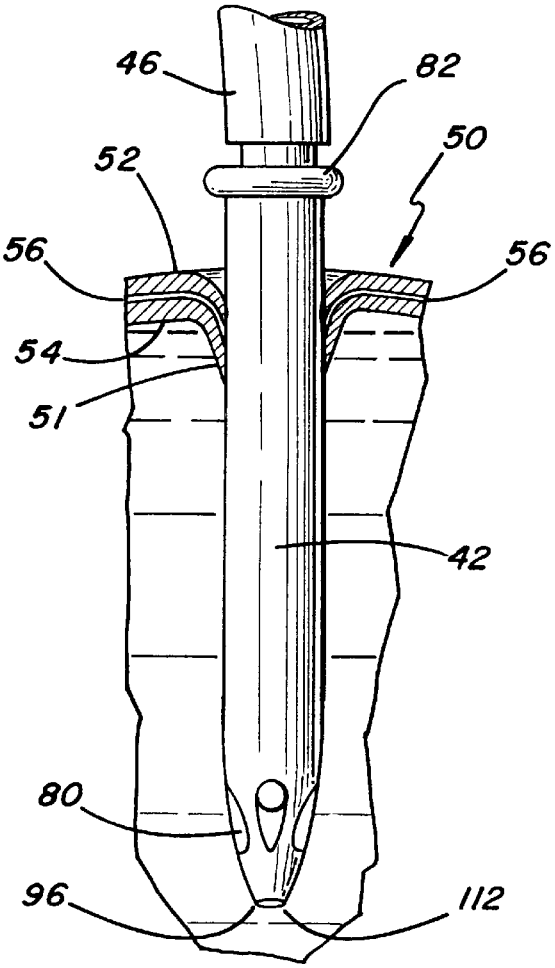
FIG. 5 is a partial cross-sectional view taken within dashed circle 5 illustrated in FIG. 2.

Referring jointly to FIGS. 2 through 5, details attendant the structure and installation of liquid soap filled bag 40 will be described in detail. The bag is formed of laminated sheet material that may be extruded as a lamination by a co-extrusion process or developed into a laminated structure by adhering one material with another. Alternatively, when new material(s) are developed or become available and suitable for this purpose, a single layer of such material may be employed. This is also the case when the liquid contains for example no volatile components so that in particular a single layer of polyethylene may be sufficient to form a barrier for the components of the liquid. The material 50 of bag 40 may be formed of an outside layer of polyamide 52 backed by and laminated to an inside layer of polyethylene 54. A polyurethane adhesive or other joining material 56 is disposed intermediate the polyamide and polyethylene layers to join both layers together. As explained hereinafter, both layers are preferably joined together in a co-extrusion process by means of a thermoplastic tie layer 56 made for example of polyethylene based on vinylacetate. It has indeed been found that the use of such a thermoplastic adhesive layer instead of a usually thermosetting adhesive layer enables to considerably reduce the problem of tear formation when inserting the needle, or, in other words, reduces the risks that, due to a premature tearing of the sheet material, no effective seal will be formed around the needle. Bag 40, as shown in FIG. 2, is formed of two laminated sheets 58,60 joined by a circumscribing seam 62. As represented in FIGS. 4 and 5, the two layers of each sheet (58,60) may be formed by co-extrusion techniques to develop material 50, requiring usually the use of intermediate thermoplastic tie layers 56 for obtaining the required adhesion between the layers, for example between a polyethylene and a polyamide layer. It may be noted that material 50 may be formed by an inner lamination of polyethylene which has the requisite properties of being chemically inert to the constituents of the contained liquid soap and sufficiently flexible and resilient to form a seal about a penetrating needle. Moreover, the lamination of polyethylene has heat responsive properties to form a seal along seam 62. As will be discussed hereinafter, the lamination of polyethylene may be a non-linear low density polyethylene (LDPE) that has a lower melting temperature than linear low density polyethylene (L-LDPE). Thus, this property can be used to advantage to form a seal along seam 62 by applying heat to the area defining the seam. With such heat sealing, no separate adhesive need be used to form the seal at the seam. The outer lamination of polyamide is impermeable to liquid soap, and in particular, to the volatile components thereof. The two laminations are adhered to one another by, for instance, a polyurethane adhesive but preferably by means of a thermoplastic tie layer in a co-extrusion process. Alternatively, the material (50) may be a single sheet of material having these properties.

Upon penetration of needle 42 into bag 40, it is preferable that a seal 51 therebetween be developed to prevent leakage of liquid soap under normal conditions of use. Furthermore, seal 51 is very important to obtain complete emptying of the bag. With a good seal, a below ambient pressure will be created within the bag by drawing liquid soap from within the bag by either a source of vacuum or by gravity. The below ambient pressure within the bag will cause the ambient pressure external to the bag to collapse the bag and squeeze all of the liquid soap from within the bag.

In the configuration of material 50 illustrated in FIGS. 3, 4, and 5, outer layer of polyamide 52 serves as an impermeable barrier to the volatile components of the liquid soap and provides a protective function to prevent damage during normal handling and storage of the soap bag. Inner layer of polyethylene 54 serves the function of preventing tearing of layer 52 upon initial penetration by needle 42, as depicted in FIG. 4. Upon further penetration of needle 42, layer of polyethylene 54 stretches, rather than tears, to exert circumscribing pressure upon the surface of the needle to develop seal 51 therebetween. As particularly depicted in FIG. 5, there will be a curl over of material 50 inwardly to maintain the material in sealing engagement with the needle. Polyamide layer 52 will remain in contact with needle 42 and polyethylene layer 54 will remain in gripping and sealing contact with the needle, as depicted.

A material which can be used in manufacturing bag 40 has for example the following composition: 0.045 mm L-LDPE as outer layer, polyurethane adhesive, 0.015 mm polyamide, polyurethane adhesive, 0.060 mm LDPE/L-LDPE as inner layer.

Figure 7:
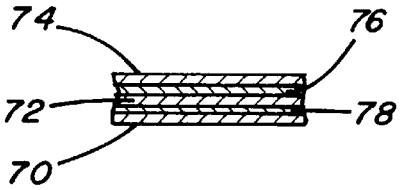
FIG. 7 illustrates cross-section of a multi-layered sheet material for the soap bag.
Figure 8:
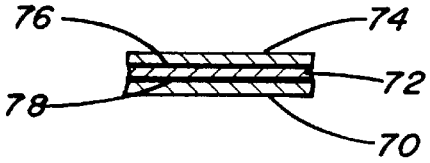
FIG. 8 illustrates a cross-section of an extruded multilayered sheet material for the soap bag.

The material includes three layers 70,72,74 laminated with one another by interleaved films of polyurethane adhesive 76,78, as shown in FIG. 7. The inner layer is a low density polyethylene (LDPE) layer 70 which is chemically inert to the constituents of the liquid soap. The middle layer is a polyamide layer 72 which is impermeable to the liquid soap. The outer layer is a layer of linear low density polyethylene (L-LDPE) 74 which serves the function of protecting the polyamide layer 72. It has a high resistivity to heat. This heat resistivity is of particular benefit during the heating process for sealing with one another the perimeters (seam 62) of the two sheets forming the bag. It should be noted that also other possibilities are known for manufacturing the bag. The bag may be formed for example from one single sheet which is first sealed in the longitudinal direction to form a cylinder after which the end of this cylinder are closed by sealing. The inner layers of polyethylene (LDPE) of each of the two sheets forming the bag are adjacent one another. Upon application of heat to the two sheets in proximity to seam 62 during sealing of the bag, the facing layers of (non-linear) low density polyethylene (LDPE) will melt and become heat welded to one another to seal the seam about the perimeter of the bag. The higher melting temperature (heat resistivity) of the outer layers of linear low density polyethylene (L-LDPE) of each of the sheets of the bag will not be affected. Similarly, the respective intermediate layers of polyamide of each of the sheets will remain unaffected. FIG. 8 illustrates the three layers (70,72,74) as part of a co-extruded sheet not requiring an adhesive to secure the layers to one another, but requiring usually a thermoplastic tie layer (76,78) between the different layers in order to obtain the required adherence.

In a preferred embodiment of the bag according to the invention, the material of the bag comprises three, in particular, co-extruded layers 70,72,74 formed successively by an L-LDPE layer 70, an impermeable barrier layer 72, for example of polyamide (PA) and again an L-LDPE layer 74. These layers have, for example, thicknesses of about 50, 30, and 50 microns, respectively, and are adhered to one another by means of co-extruded thermoplastic tie layers 76,78 having a thickness of for example about 5 microns. As material of these tie layers, use is preferably made of polyethylene based on vinylacetate. It has been found that the use of a linear LDPE layer also at the inside of the bag and especially the use of thermoplastic tie layers instead of thermosetting adhesive layers is advantageous in view of the fact that upon penetration of the needle, a depression is first formed in the wall of the bag as a result of elongation of the material of the wall after which the needle penetrates through the wall. The elongated material encloses the needle over a longer distance thus providing a more effective seal. It has been found that this effect is more pronounced when use is made of L-LDPE as an inner layer and especially when use is made of co-extruded thermoplastic tie layers since these features enable a longer elongation of the sheet material before it is penetrated by the needle. Sealing of the bag can still be done by heat welding or, alternatively, by making use of a sealant.

Figure 6:
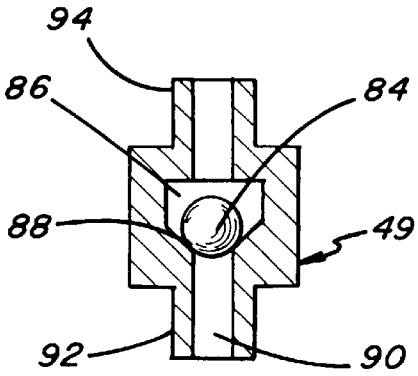
FIG. 6 illustrates a check valve for preventing return flow of liquid soap.

Referring jointly to FIGS. 2, 5, and 6, further details of the structure will be described. Needle 42 may include one or more inlets 80 to accommodate flow of soap 44 into the hollow needle and thence into conduit 46. As shown in the figures, the needle 42 has an opening 96 at its distal extremity, i.e. at its tip so that upon initial insertion of the needle in the bag, the liquid contained in the bag and pressurized by the pressure exerted thereon by the needle, can flow into the needle, thus reducing the risk of leakage of liquid along the needle when inserting the needle into the bag. It has indeed been found that when no opening is provided in the tip of the needle, liquid usually will leak out of the bag when the needle penetrates the bag due to the pressure which is exerted on the bag by the penetrating needle. An important feature of a first aspect of the needle according to the invention is that its open tip is flatted. This feature is especially important in case the distal end of the needle is not or almost not tapered. Known needles arranged for being inserted into flexible bags are either pointed or are not tapered but have an open bevelled tip presenting a sharp piercing edge. Reference can for example be made to U.S. Pat. No. 4,316,555. According to a first aspect of the invention, it has however been found that, when the needle has no tapered distal end and shows a bevelled tip with a sharp piercing edge, a slit is formed in the material of the bag before it has been elongated sufficiently, as described hereinabove, to develop a seal around the needle. With an open flatted tip, on the contrary, the material of the bag is first considerably stretched so that a depression is formed and so that the needle penetrates through this stretched material. In this way the stretched material encloses the needle over a longer distance providing an effective seal. Moreover, only a relatively small hole is made due to the fact that the needle penetrates the bag through a stretched portion of the bag wall. It has been observed that this hole may even close back completely when withdrawing the needle from the bag, thus preventing any leakage when removing an empty bag. The flatted tip has preferably an edge situated in a plane which extends substantially at right angles to the longitudinal axis of the needle. A collar 82, or the like, may be formed upon needle 42 to limit the extent of penetration of the needle into bag 40. Preferably, the needle has however no collar so that it can be inserted entirely in the bag, the necessary seal being in this case formed around the conduit connected to the needle. In this way, the needle may lay flat on the bottom of the bag which helps in obtaining a complete emptying of the bag. Check valve 49 may be a conventional one-way valve having a ball element 84 disposed within a cavity 86. The ball will close orifice 88 of passageway 90 in response to a reverse flow of liquid soap into bag 40. Gravity may be used to bias ball 84 toward orifice 88 or a spring may be used for this purpose (as is conventional). Conduit 46 is mounted upon hollow boss 92 and an extension 47 of conduit 46 is mounted upon hollow boss 94.

Figure 9A:
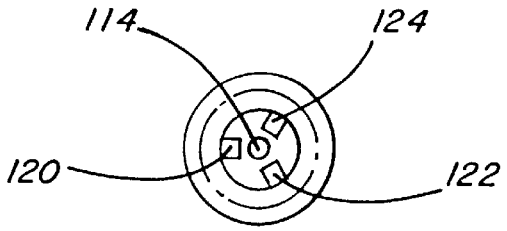
FIG. 9A is an end view of the needle shown in FIG. 9
Figure 9B:
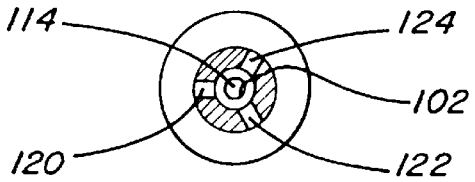
FIG. 9B illustrates a cross-section of the needle taken at A/B as shown in FIG. 9.
Figure 9:
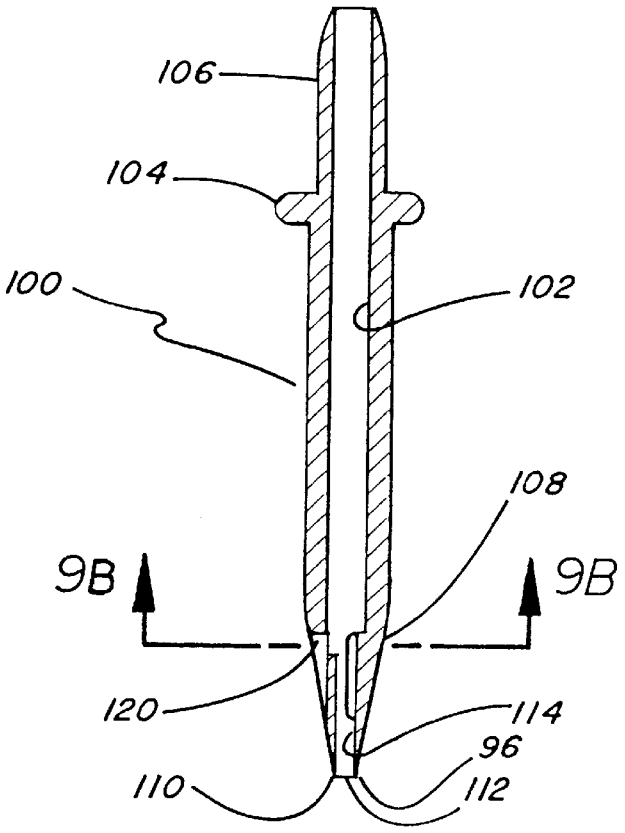
FIG. 9 illustrates a further configuration of a penetrating needle.

FIGS. 9, 9A and 9B illustrate a configuration of a needle 100 particularly suited for penetration of the above described material for the soap bag. The needle is generally cylindrical and includes a passageway 102 extending along the longitudinal axis of the needle. A collar 104 may be incorporated to limit the extent to which an attached conduit will overlap the proximal end 106 of the needle. As discussed above, this collar may be omitted to permit complete penetration of the needle into the soap bag and whereby the seal at the point of penetration of the material will extend about the exterior surface of the attached conduit. Accordingly to a second aspect of the invention, distal end 108 of the needle is tapered to a point defined by opening 96. Preferably, the opening is formed by a flatted tip 110 discussed above as an important feature of a first aspect of the invention. The tip may be in the form of an annular band 112 lying in a plane orthogonal to the longitudinal axis of needle 100. The width of such band is primarily a function of the degree of stretch of the material of the bag desired prior to penetration of the material by the tip 110. It is to be understood that the tip may include a bevel or even define a circular cutting edge. However, experiments suggest that if annular band 112 is beveled or defines a circular cutting edge, the material of the soap bag will stretch only a minor amount prior to penetration and there is a resulting possibility of escape of fluid from within the soap bag intermediate the material and the exterior surface of distal end 108.

Opening 96 is in fluid communication with a passageway 114 extending through the distal end along the longitudinal axis of the needle. The diameter of passageway 114 is preferably less than the diameter of passageway 102. Three equiangularly spaced slots 120, 122, and 124 are disposed in distal end 108 of needle 100 and aligned generally with the longitudinal axis of the needle. As shown in FIG. 9 with respect to slot 120, the depth of these slots tapers and expands proximally as a function of the taper of the distal end. The proximal end of each of slots 120, 122, and 124 extends into fluid communication with passageway 102; note also FIG. 9B. Thereby, fluid from within the soap bag, after penetrable engagement by needle 100, flows into needle through passageway 114 and through each of slots 120, 122, and 124. By maintaining the total cross-sectional area of these elements essentially commensurate with cross-sectional area of passageway 102, inflow of fluid into passageway 102 would not be restricted by the configurations of the ingresses to the passageway. It has been found experimentally that when inserting the needle into the bag, the above described structure of the needle prevents liquid entering through opening 96 from flowing through the slots. This is also due to the fact that these slots are very quickly closed off by the material of the bag as described hereinafter with reference to FIG. 10C.

Figure 10A:
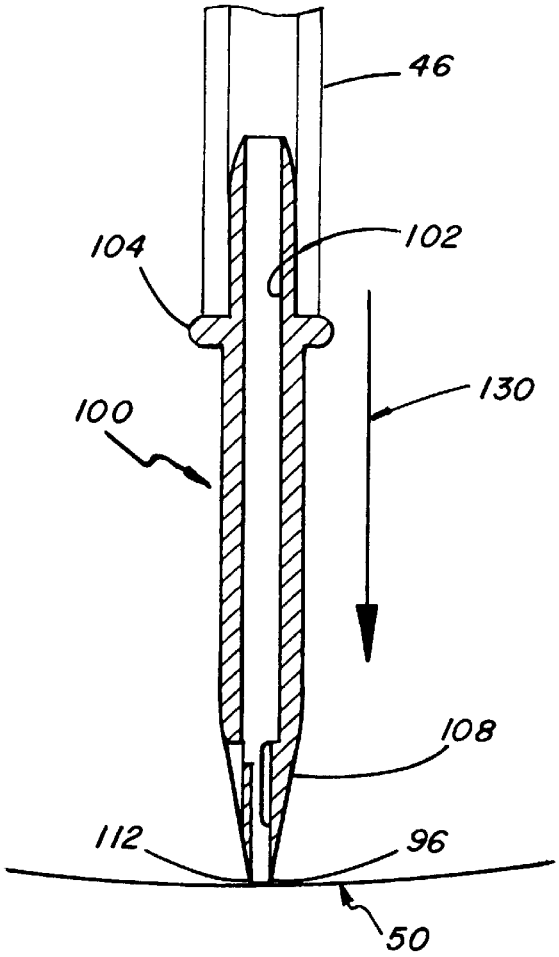
FIGS. 10A, 10B, 10C, and 10D illustrate the progression of penetration of the soap bag by the needle.
Figure 10B:
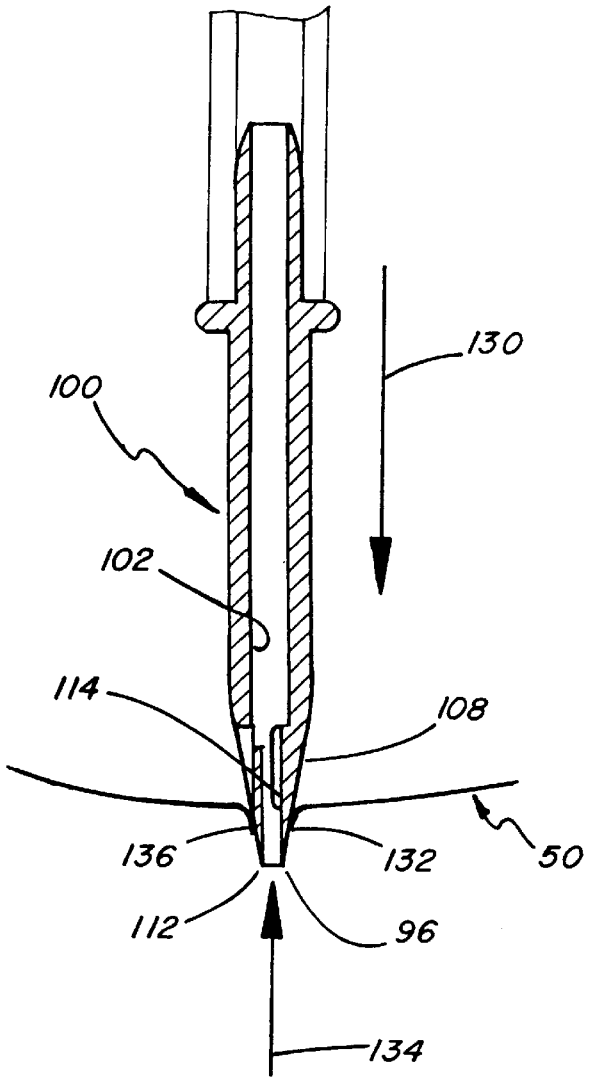

The operation attendant penetration of needle 100 with material 50 will be described with joint reference to FIGS. 10A, 10B, 10C, and 10D. The initial contact of annular band 112 defining opening 96 at tip 110 of distal end 108 with material 50 is depicted in FIG. 10A. Such initial contact is brought about by manually or otherwise urging needle 100 toward the material, as depicted by arrow 130. It is to be understood that in certain embodiments of the invention, the needle may be fixed with the soap bag being brought into engagement with the needle. In such event, arrow 130 would have a reverse direction and would be in reference to movement of material 50. After initial contact by distal end 108 with material 50, the material will stretch to form a depression 132 commensurate with the configuration of the distal end in contact with the material. This is particularly shown in FIG. 11A. FIG. 11B illustrates depression 132 formed by the distal end of the needle but the needle has been omitted for clarity of illustration of the depression. At some point, the annular band of distal end 108 will penetrate material 50, as depicted in FIG. 10B. Upon such penetration, fluid communication will be established between the interior of the soap bag and passageways 114 and 102. With such communication, the fluid within the soap bag will flow through opening 96 and into the passageways, as depicted by arrow 134. Because of the characteristics of resilience and stretchability of material 50, skirt 136 defining the side wall of depression 132, will be in close and gripping contact with the surface of distal end 108 to prevent fluid flow intermediate the distal end and the skirt.

Figure 10C:
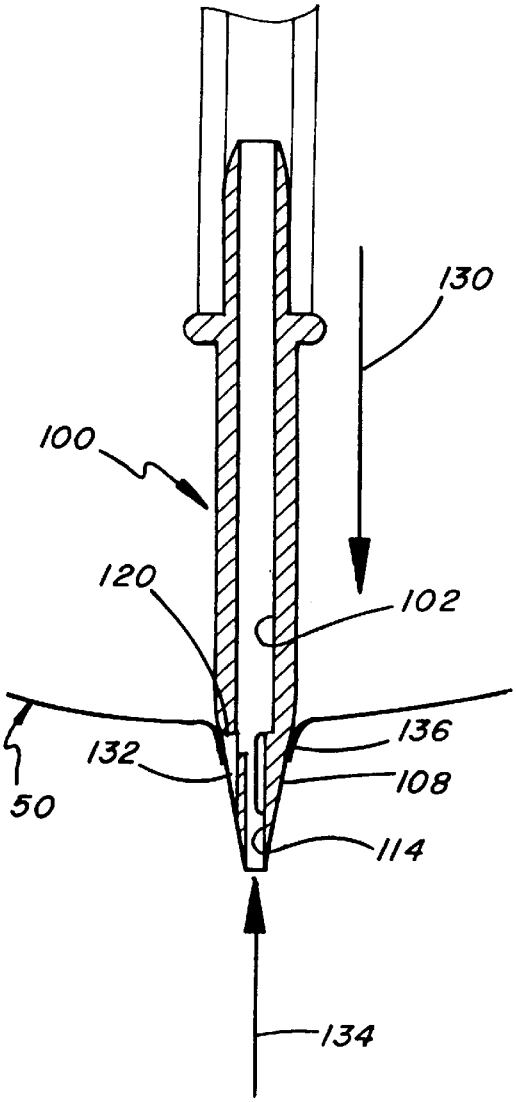
Figure 11A:
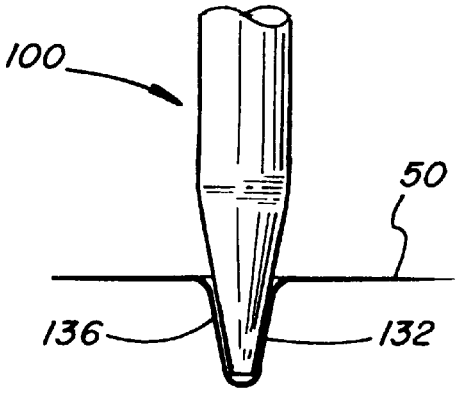
FIGS. 11A, 11B, 12A, 12B, 13A, and 13B illustrate the conformance of the material of the soap bag during insertion of the needle.
Figure 11B:
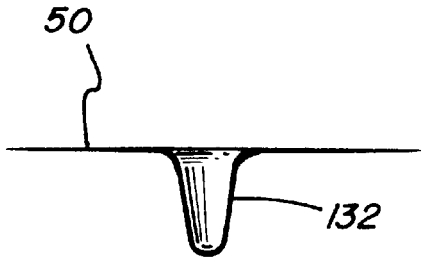
Figure 12A:
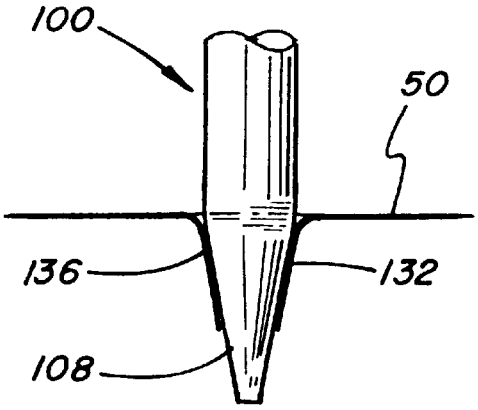
Figure 12B:
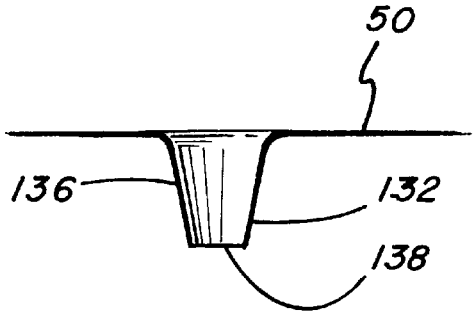

Upon further penetration of needle 100, as represented by arrow 130 in FIG. 10C, fluid will flow into passageways 114 and 102, as depicted by arrow 134. Simultaneous with penetrating movement of needle 100, depression 132 is enlarged as a function of the taper configuration of distal end 108. At this point, depression 132 has assumed the configuration illustrated in FIG. 12A about distal end 108. This configuration is also shown in FIG. 12B with penetrating distal end 108 being removed from within the depression. It is noted that the bottom of the depression defines a hole 138 through which distal end 108 penetrates. In the relative position between the material of depression 132 and distal end 108, skirt 136 essentially overlaps slots 120, 122, and 124. Such overlap prevents fluid inflow therethrough. It also prevents fluid outflow from passageway 114 to a location exterior of needle 100 and material 50.

Figure 10D:
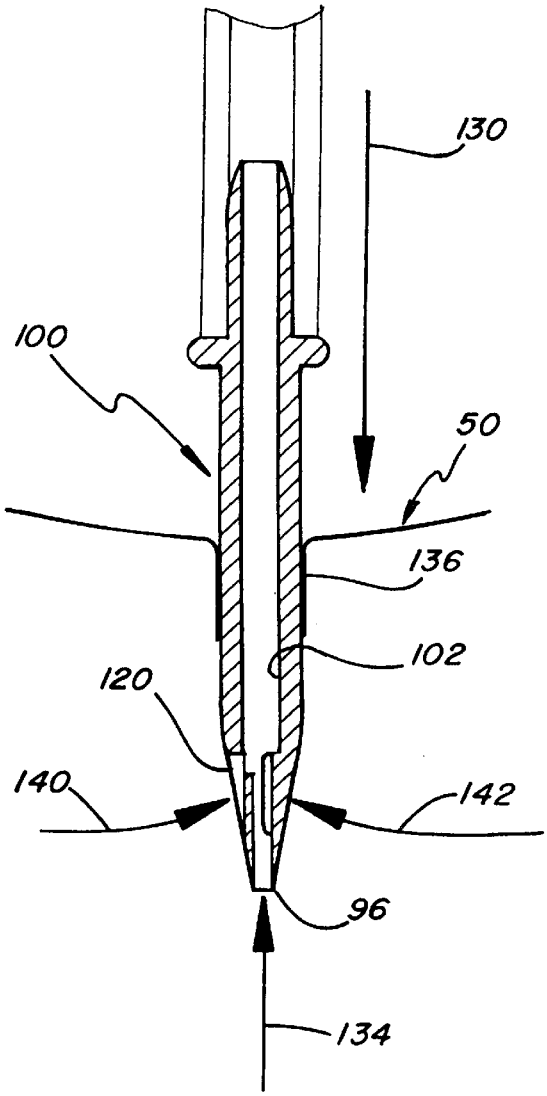
Figure 13A:
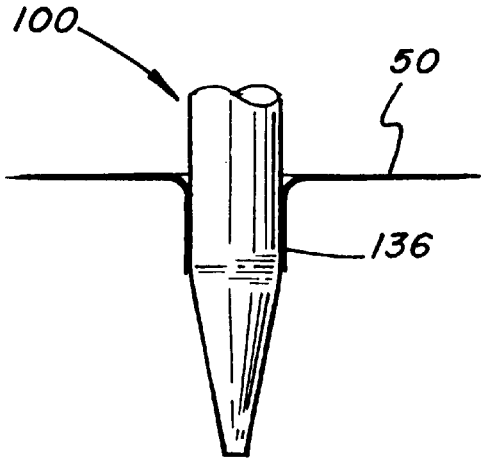
Figure 13B:
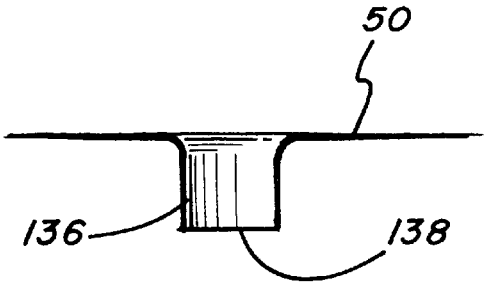

With yet further application of force to cause penetration of needle 100 with material 50, as represented by arrow 130, the main body of the needle will be circumferentially gripped by skirt 136, as depicted in FIG. 10D. Because of the resilience and stretchability of material 50, skirt 136 will grippingly engage the circumference of needle 100 sufficiently tightly to prevent flow of fluid therebetween at the operating pressures attendant fluid discharge. At the state of penetration depicted in FIG 10D, slots 120, 122, and 124 are exposed within the soap bag. With such exposure, fluid will flow from within the soap bag into passageway 102 of the needle through the slots, as depicted by arrows 140,142 and into passageway 114 through opening 96, as depicted by arrow 134. As shown collectively in FIGS. 13A and 13B, skirt 136 of material 50 defines essentially an open-ended cylinder in gripping engagement with the circumference of needle 100. In practice, the open ended cylinder of material 50 may have a longitudinal length on the order of 2 to 3 mm, which length, in combination with the characteristics of the material, provides a leak proof junction.

After bag 40 becomes sufficiently evacuated to prevent further discharge of liquid soap 44, an operator withdraws needle 42 from the evacuated bag. After replacement of the evacuated bag with a filled bag, the operator inserts needle 42 into the replacement bag. Such insertion will form a sealed engagement (seal 51) with bag 40 as described above and illustrated in FIG. 5. If a three layer sheet (see FIGS. 7 and 8) is used, both the inner and outer layers (preferably of LDPE) will grippingly circumscribe and sealingly engage the cylindrical surface of the needle. After withdrawal of needle 42 from bag 40, the resilient nature of material 50 will tend to essentially close the opening formed upon penetration of the needle. Thus, leakage of liquid soap from the essentially evacuated bag is of minimal, if any, concern. From this description, it will be apparent that installation and replacement of liquid soap filled bag 40 is easy to accomplish with minimal likelihood of spillage of liquid soap or of the collection of liquid soap residue at and about the location of the bag.

While the invention has been described with reference to several particular embodiments thereof, those skilled in the art will be able to make the various modifications to the described embodiments of the invention without departing from the true spirit and scope of the invention. It is intended that all combinations of elements and steps which perform substantially the same function in substantially the same way to achieve the same result are within the scope of the invention.

It will, for example, be clear that the entire bag or container does not have to consist of a flexible material but that part thereof may be made of a rigid material. Further, the bag does not have to be made entirely of the above-described preferred material or layers. Indeed, the same results can be obtained in case the wall of the bag is made of these materials in a predetermined area through which the needle will be inserted. In case the bag would consist of one or more layers which would tear upon insertion of the quite large hollow needle, flexible, stretchable, resilient plastic stickers may be provided, made in particular of preferably linear LDPE, which can be adhered to the bag to prevent tearing thereof and to enable to form a seal about the inserted needle.

Further, the needle may for example be rigidly fixed to the dispenser, in particular in the support for the bag having its point directed upwards so that the needle is automatically inserted into the bag when placing this bag onto the support provided therefor.

What is claimed is:

1. Apparatus for dispensing a personal hygiene liquid, said apparatus comprising in combination:

(a) a dispenser having an outlet for discharging the liquid;

(b) a supply of the liquid to be dispensed;

(c) a flexible collapsible container for housing said supply of liquid, said container comprising a laminate of sheet materials having at least two layers;

(d) a hollow needle and attached conduit interconnecting said needle with said outlet of said dispenser for penetrably engaging said container in fluid communication with the liquid, said needle having an open tip;

(e) a seal formable by said sheet material about the respective circumference of said needle and said conduit;

(f) said laminate including at least a layer for forming said seal, said seal forming layer being flexible and resiliently stretchable to develop a grip about the respective one of said needle and said conduit to form said seal and to prevent tearing of said laminate upon penetration of said needle.

2. The apparatus as set forth in claim 1 wherein said seal forming layer is chemically inert to the liquid.

3. The apparatus as set forth in claim 1 wherein said seal forming layer is a sheet of low density polyethylene (LDPE).

4. The apparatus as set forth in claim 1 wherein said seal forming layer is a sheet of linear low density polyethylene (L-LDPE).

5. The apparatus as set forth in claim 1 wherein another layer of said laminate includes a layer impermeable to the liquid.

6. The apparatus as set forth in claim 5 wherein said impermeable layer is disposed exterior to said seal forming layer.

7. The apparatus as set forth in claim 2 wherein another layer of said laminate comprises a layer impermeable to the liquid and disposed exterior of said seal forming layer.

8. The apparatus as set forth in claim 6 wherein said impermeable layer is a sheet of polyamide.

9. The apparatus as set forth in claim 7 wherein said impermeable layer is a sheet of polyamide.

10. The apparatus as set forth in claim 6 wherein said laminate includes a further layer disposed exterior to said impermeable layer.

11. The apparatus as set forth in claim 7 wherein said laminate includes a further layer disposed exterior to said impermeable layer.

12. The apparatus as set forth in claim 10 wherein said seal forming layer is low density polyethylene (LDPE).

13. The apparatus as set forth in claim 10 wherein said seal forming layer is linear low density polyethylene (L-LDPE).

14. The apparatus as set forth in claim 11 wherein said seal forming layer is low density polyethylene (LDPE).

15. The apparatus as set forth in claim 11 wherein said seal forming layer is linear low density polyethylene (L-LDPE ).

16. The apparatus as set forth in claim 10 wherein said further layer is linear low density polyethylene (L-LDPE).

17. The apparatus as set forth in claim 11 wherein said further layer is linear low density polyethylene (L-LDPE).

18. The apparatus as set forth in claim 1 wherein said laminate includes a thermoplastic co-extruded tie layer disposed between said seal forming layer and said impermeable layer.

19. The apparatus as set forth in claim 18 wherein said tie layers are polyethylene layers based on vinylacetate.

20. The apparatus as set forth in claim 1 wherein said layers of said laminate are adhered to one another with a polyurethane adhesive.

21. The apparatus as set forth in claim 1 including a source of vacuum for causing the liquid to be evacuated from said container and discharged through said outlet.

22. The apparatus as set forth in claim 1 including means for locating said container relative to said outlet to have the force of gravity cause the liquid to be evacuated from said container and discharged through said outlet.

23. A collapsible closed bag for dispensing a personal hygiene liquid housed therein, said bag comprising: a closed container for containing the liquid, said container being formed of a co-extruded laminated flexible material having at least a first layer impermeable to the liquid and a second layer of flexible, stretchable, resilient plastic comprising low density polyethylene to develop a seal about a needle penetrating said laminated flexible material, which needle defines the outflow path of the liquid from said container.

24. The collapsible closed bag as set forth in claim 23 wherein said second layer is chemically inert to the liquid and is disposed interior to said first layer.

25. The collapsible bag as set forth in claim 23 wherein said first and second layers comprise polyamide, and low density polyethylene (LDPE), respectively.

26. The collapsible bag as set forth in claim 25 wherein said second layer comprises linear low density polyethylene (L-LDPE).

27. The collapsible bag as set forth in claim 23 wherein said material includes a third layer of flexible, stretchable, resilient plastic disposed exterior of said first layer.

28. The collapsible bag as set forth in claim 27 wherein said third layer is made of linear low density polyethylene (L-LDPE).

29. The collapsible bag as set forth in claim 23 wherein said material comprises said first and second layers co-extruded with at least one thermoplastic tie layer co-extruded therebetween.

30. The collapsible bag as set forth in claim 29 wherein said tie layer is a polyethylene layer based on vinylacetate.

31. The collapsible bag as set forth in claim 23 wherein said container includes a perimeter and a seam disposed at least along a part of said perimeter.

32. The collapsible bag as set forth in claim 31 wherein said seam is a heat sealed seam.

33. Apparatus for dispensing a liquid from an outlet of a dispenser, said apparatus comprising in combination:

(a) a flexible, collapsible, sealed bag for containing the liquid, said bag including flexible, stretchable, resilient material comprising a laminate having at least two layers;

(b) a hollow needle having a circumference for penetrable engagement with said bag and a conduit having a circumference and extending from said needle for conveying the liquid from within said bag to the outlet of the dispenser, said needle having an open tip; and (c) a seal formed about the penetrably engaged one of said needle and said conduit by at least one of said layers of said laminate constrictively and retentively engaging the circumference of the respective one of said needle and said conduit.

34. The apparatus of claim 33 wherein one layer of said laminate is chemically inert to the liquid, is in fluid communication with the liquid and forms said seal.

35. The apparatus of claim 34 wherein another layer of said laminate is impermeable to the liquid.

36. The apparatus of claim 34 wherein said one layer is of low density polyethylene.

37. The apparatus of claim 34 wherein said one layer is of linear low density polyethylene.

38. The apparatus of claim 35 wherein said other layer is of polyamide.

39. The apparatus of claim 35 including a further layer for forming said seal, said further layer being disposed exterior to said other layer.

40. The apparatus as set forth in claim 1 wherein said needle includes a tapering distal end for penetrating said container and terminated by said open tip.

41. The apparatus as set forth in claim 40 wherein said open tip includes an annular band defining an opening of said open tip.

42. The apparatus as set forth in claim 41 wherein said needle includes a longitudinal axis extending for the length of said needle and wherein said annular band is oriented orthogonal to the longitudinal axis of said needle.

43. The apparatus as set forth in claim 40 wherein said hollow needle includes a passageway extending therethrough and including at least one further passageway disposed in said distal end in fluid communication with said passageway.

44. The apparatus as set forth in claim 43 wherein said further passageway comprises at least one slot.

45. The apparatus as set forth in claim 44 wherein said at least one slot comprises three equiangularly spaced slots disposed in said distal end.

46. The apparatus as set forth in claim 43 wherein said passageway comprises a first passageway of a first cross-sectional size extending from said open tip and a second passageway of a second cross-sectional size greater than the size of the first cross-section of said first passageway and wherein said at least one further passageway is in direct fluid communication with said second passageway.

47. The apparatus as set forth in claim 45 wherein said passageway comprises a first passageway of a first cross-sectional size extending from said open tip and a second passageway of a second cross-sectional size greater than the size of the first cross-section of said first passageway and wherein said three slots are in direct fluid communication with said second passageway.

48. The apparatus as set forth in claim 33 wherein said needle includes a tapering distal end for penetrating said container and terminated by said open tip.

49. The apparatus as set forth in claim 48 wherein said open tip includes an annular band defining an opening of said open tip.

50. The apparatus as set forth in claim 49 wherein said needle includes a longitudinal axis extending for the length of said needle and wherein said annular band is oriented orthogonal to the longitudinal axis of said needle.

51. The apparatus as set forth in claim 48 wherein said hollow needle includes a passageway extending therethrough and including at least one further passageway disposed in said distal end in fluid communication with said passageway.

52. The apparatus as set forth in claim 51 wherein said further passageway comprises at least one slot.

53. The apparatus as set forth in claim 52 wherein said at least one slot comprises three equiangularly spaced slots disposed in said distal end.

54. The apparatus as set forth in claim 51 wherein said passageway comprises a first passageway of a first cross-sectional size extending from said open tip and a second passageway of a second cross-sectional size greater than the size of the first cross-section of said first passageway and wherein said at least one further passageway is in direct fluid communication with said second passageway.

55. The apparatus as set forth in claim 53 wherein said passageway comprises a first passageway of a first cross-sectional size extending from said open tip and a second passageway of a second cross-sectional size greater than the size of the first cross-section of said first passageway and wherein said three slots are in direct fluid communication with said second passageway.

* * * * *